US009945133B2

(12) United States Patent
Hoffman et al.

(10) Patent No.: US 9,945,133 B2
(45) **Date of Patent: *Apr. 17, 2018**

(54) SYSTEM AND METHOD FOR ALIGNING AND LEVELING TILE

(71) Applicant: New Standards Manufacturing Co., Keokuk, IA (US)

(72) Inventors: James P Hoffman, Keokuk, IA (US); Ernest L Perry, IV, Vinton, IA (US); Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 587 days.

This patent is subject to a terminal disclaimer.

(21) Appl. No.: 14/186,729

(22) Filed: Feb. 21, 2014

(65) Prior Publication Data

US 2015/0240504 A1 Aug. 27, 2015

Related U.S. Application Data

(62) Division of application No. 14/030,346, filed on Sep. 18, 2013, now Pat. No. 8,689,521, which is a division (Continued)

(51) Int. Cl.
*E04F 21/20* (2006.01)
*E04F 21/18* (2006.01)

(Continued)

(52) U.S. Cl.
CPC ..... *E04F 21/20* (2013.01); *E04F 15/0215* (2013.01); *E04F 21/0092* (2013.01);

(Continued)

(58) Field of Classification Search
CPC ... E04F 10/00; E04F 2201/00; E04F 21/0092; E04F 21/20; E04F 21/22;

(Continued)

(56) References Cited

U.S. PATENT DOCUMENTS 1,918,228 A 7/1933 Spencer
2,277,892 A 3/1942 Swenson (Continued)

FOREIGN PATENT DOCUMENTS

JP 07-305494 A 11/1995
KR PCT/US2012/055482 5/2013

OTHER PUBLICATIONS

MLT (Mechanical Lippage Tuning Catalog 2015-2016.*

(Continued)

*Primary Examiner* — Christopher M Koehler
*Assistant Examiner* — Mahdi H Nejad
(74) *Attorney, Agent, or Firm* — Simmons Perrine Moyer Bergman PLC

(57) ABSTRACT

A tile aligning and leveling system that uses an under tile base re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

20 Claims, 5 Drawing Sheets

Related U.S. Application Data of application No. 13/855,537, filed on Apr. 2, 2013, now Pat. No. 8,561,370, which is a division of application No. 13/707,369, filed on Dec. 6, 2012, now Pat. No. 8,572,927, which is a division of application No. 13/296,737, filed on Nov. 15, 2011, now Pat. No. 8,429,878.

(51) Int. Cl.

| | |
|---|---|
| ***E04F 21/00*** | (2006.01) |
| ***E04F 21/22*** | (2006.01) |
| ***E04F 15/02*** | (2006.01) |
| *E04F 13/08* | (2006.01) |

(52) U.S. Cl.

CPC ..... *E04F 21/1877* (2013.01); *E04F 21/22* (2013.01); *E04F 13/0892* (2013.01); *Y10T 29/53796* (2015.01)

(58) Field of Classification Search

CPC ..... E04F 15/02022; E04F 13/0892; E04F 21/1877; E04F 15/0215; A61B 17/688; D04F 21/0092; Y10T 29/53796

USPC ..... 52/747.11, 749.11, 126.1–126.7; 7/33, 7/526; 29/244–282; 606/324, 916; 33/DIG. 20, 527, 645, 526, 533; 269/3.6, 269/95

See application file for complete search history.

(56) References Cited

U.S. PATENT DOCUMENTS 3,511,001 A 5/1970 Morgan
4,397,125 A * 8/1983 Gussler, Jr. ..... E04F 21/22 52/127.3
4,503,654 A * 3/1985 Cosentino ..... E04F 13/0885 428/192
4,744,194 A * 5/1988 Yasuyoshi ..... E04F 15/02458 52/126.6
4,862,668 A * 9/1989 DeGooyer ..... E01C 5/006 52/232
5,345,990 A 9/1994 Potts
5,350,399 A * 9/1994 Erlebacher ..... A61B 17/0057 128/899
5,603,195 A * 2/1997 Cosentino ..... E04F 13/0892 52/127.3
5,675,942 A * 10/1997 Crawford ..... E04F 13/0892 52/127.3
5,843,546 A 12/1998 Eichhorn
6,022,351 A * 2/2000 Bremer ..... A61B 17/688 606/324
6,253,515 B1 7/2001 Kuelker
6,625,951 B1 * 9/2003 McCarthy ..... E04D 11/007 156/297
6,755,834 B2 * 6/2004 Amis ..... A61B 17/688 606/104
7,257,926 B1 * 8/2007 Kirby ..... E04F 21/0092 33/526
D552,266 S 10/2007 Murdock
7,621,100 B2 11/2009 Kufner et al.
D621,966 S 8/2010 Vaes
D630,077 S * 1/2011 Kufner ..... D8/105
D630,078 S * 1/2011 Kufner ..... D8/105
7,861,487 B2 1/2011 Kufner et al.
7,946,093 B1 * 5/2011 Sturino ..... E04F 21/0092 33/527
D640,119 S 6/2011 Kufner et al.
7,954,300 B1 * 6/2011 Kufner ..... E04F 21/0092 33/526
7,992,354 B2 8/2011 Doda
8,079,199 B1 * 12/2011 Kufner ..... E04F 13/0892 33/526
D658,963 S * 5/2012 Kufner ..... D8/105
8,181,420 B2 * 5/2012 Torrents I Comas ..... E04F 21/0092 52/127.7
8,241,342 B2 * 8/2012 Kirschman ..... A61B 17/688 606/324
8,429,787 B2 * 4/2013 Maynard ..... B08B 7/0028 15/102
8,429,878 B1 * 4/2013 Hoffman ..... E04F 13/0889 52/747.11
8,429,879 B1 * 4/2013 Hoffman ..... E04F 21/0092 52/747.11
8,689,522 B2 * 4/2014 Hoffman ..... E04F 21/00 52/747.11
8,800,246 B2 * 8/2014 Gorton ..... E04F 21/22 52/747.11
9,010,064 B1 * 4/2015 Farahmandpour .... E04B 1/7616 52/714
9,027,308 B2 * 5/2015 Kufner ..... E04F 21/00 52/126.6
9,045,911 B2 * 6/2015 Hoffman ..... E04F 21/0092
9,097,026 B2 * 8/2015 Hoffman ..... E04F 21/22
9,149,276 B2 * 10/2015 Voss ..... A61B 17/0057
9,228,363 B2 * 1/2016 Kufner ..... E04F 21/0092
9,267,297 B2 * 2/2016 Zinssler ..... E04F 13/0803
9,279,259 B1 * 3/2016 Russo ..... E04F 21/20
9,322,185 B1 * 4/2016 Russo ..... E04F 21/0092
9,353,515 B2 * 5/2016 Farahmandpour .... E04B 1/4178
9,433,438 B2 * 9/2016 Memmolo ..... A61B 17/688
9,464,448 B2 * 10/2016 Hoffman ..... E04F 21/22
9,657,485 B2 * 5/2017 Meyers ..... E04F 21/1877
2003/0229349 A1 * 12/2003 Wellisz ..... A61B 17/688 606/70
2006/0185269 A1 8/2006 Kufner et al.
2006/0185319 A1 * 8/2006 Kufner ..... E04F 13/0892 52/749.11
2007/0214743 A1 * 9/2007 Alvarez ..... E04F 21/0092 52/749.11
2008/0141617 A1 * 6/2008 Joski ..... E04F 21/0092 52/749.11
2008/0236094 A1 * 10/2008 Doda ..... E04F 13/0892 52/749.11
2008/0275511 A1 * 11/2008 Weinacker ..... A61B 17/8869 606/324
2010/0263304 A1 * 10/2010 Torrents I Comas ..... E04F 21/0092 52/126.5
2010/0287868 A1 * 11/2010 Kufner ..... E04F 21/0092 52/391
2011/0011031 A1 1/2011 Kufner et al.
2011/0265424 A1 11/2011 Kufner et al.
2012/0085066 A1 4/2012 Kufner et al.
2012/0144773 A1 * 6/2012 Mauro ..... E04F 21/0092 52/747.11
2013/0055675 A1 * 3/2013 Sighinolfi ..... E04F 15/02022 52/749.11
2013/0067854 A1 * 3/2013 Bordin ..... E04F 21/0092 52/749.11
2013/0074425 A1 * 3/2013 Miyamoto ..... E04F 13/0839 52/126.7
2013/0118115 A1 * 5/2013 Hoffman ..... E04F 21/0092 52/747.11
2013/0247508 A1 * 9/2013 Hoffman ..... E04F 21/00 52/749.11
2013/0255182 A1 * 10/2013 Kufner ..... E04F 21/00 52/749.11
2014/0116001 A1 * 5/2014 Ghelfi ..... E04F 21/0092 52/749.11
2014/0223755 A1 * 8/2014 Madrack ..... E04F 21/22 33/645
2014/0283401 A1 * 9/2014 Kufner ..... E04F 21/0092 33/527
2014/0298736 A1 * 10/2014 Bunch ..... E04F 21/0092 52/126.1
2014/0325935 A1 * 11/2014 Hoffman ..... E04F 21/22 52/747.11

(56) References Cited

U.S. PATENT DOCUMENTS

| | | | | |
|---|---|---|---|---|
| 2014/0325936 | A1* | 11/2014 | PSaila | E04F 21/1877 52/749.11 |
| 2015/0027082 | A1* | 1/2015 | Hoffman | E04F 21/0092 52/749.11 |
| 2015/0113895 | A1 | 4/2015 | Zinssler | |
| 2015/0211243 | A1* | 7/2015 | Irvine | E04F 21/0092 52/126.1 |
| 2015/0308130 | A1* | 10/2015 | Biec | E04F 21/0092 52/749.11 |
| 2015/0337546 | A1* | 11/2015 | Hoffman | E04F 21/22 52/126.5 |
| 2016/0053501 | A1* | 2/2016 | Torrents I Comas | E04F 21/22 52/749.11 |
| 2016/0348381 | A1* | 12/2016 | Meyers | E04F 21/1877 |

OTHER PUBLICATIONS

MLT leveling system (wayback machine).*
Kufner et al, The Lippage-Free Tile System, Web (www.tuscanleveling.com), 2006, Fairfield, IA.

* cited by examiner

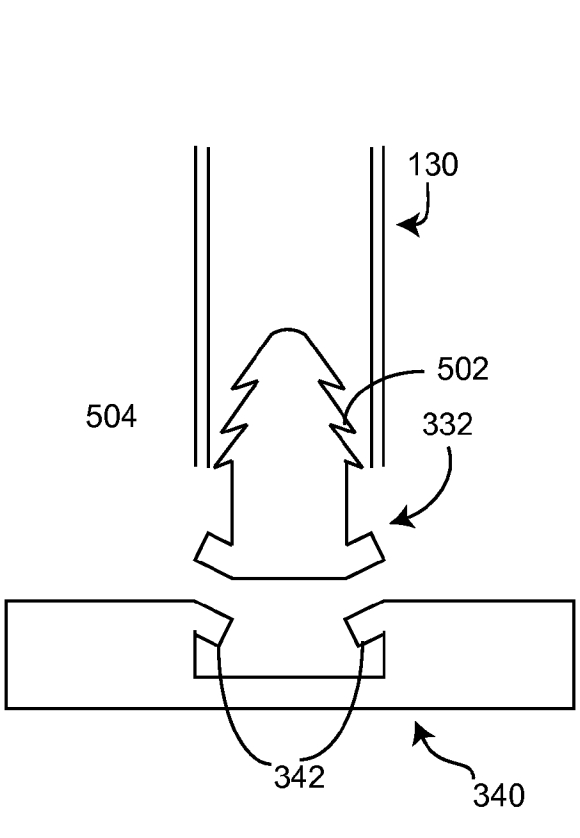
FIG. 6
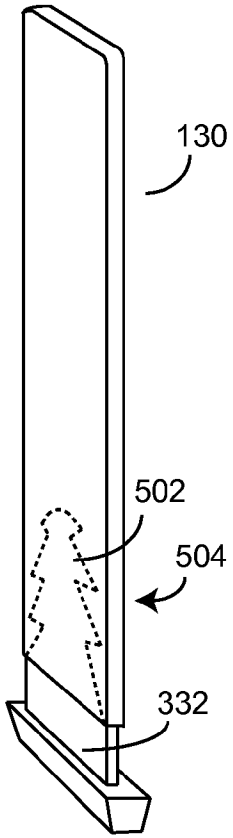
FIG. 5
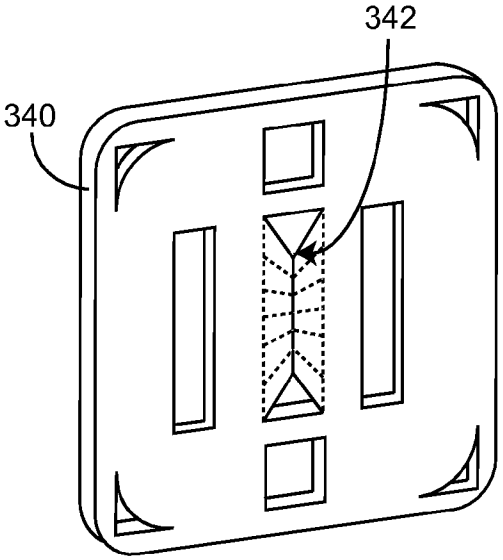

SYSTEM AND METHOD FOR ALIGNING AND LEVELING TILE

CROSS-REFERENCE TO RELATED APPLICATION

This application is a divisional of the issued patent with the same title and by the same inventors with the issued date of Apr. 8, 2014 and having U.S. Pat. No. 8,689,521; which issued patent was a divisional of the issued patent with the same title and by the same inventors with the issued date of Oct. 22, 2013 and having U.S. Pat. No. 8,561,370; which issued patent was a divisional of the issued patent with the same title and by the same inventors with the issued date of Nov. 5, 2013 and having U.S. Pat. No. 8,572,927; and which issued patent was a divisional of the issued patent with the same title and by the same inventors with the issued date of Apr. 30, 2013 and having U.S. Pat. No. 8,429,878, which patents are incorporated herein by reference in their entirety.

BACKGROUND OF THE INVENTION

This invention relates to systems and methods for laying tile and, more specifically, for efficiently reducing tile lippage. Throughout this description, the term tile is used as an example of various matter which is arranged disposed adjacent a substrate (which can be horizontal-floors or vertical-walls or other) in multiple pieces, the term tile should be understood to include panels, sheets, boards, paving stones, bricks or the like. The present invention relates more specifically to improved methods and systems which use tab systems to align and level tiles.

U.S. Pat. No. 7,861,487 and U.S. Design Pat. D63077 and the web site www.tuscanleveling.com describe a system for aligning and leveling tiles. While such systems have enjoyed some success in the past, they do have drawbacks. At the conclusion of each job, the vertical shafts extending upwardly between the tile joints in such design are broken away from the base and discarded. This generates waste that may be disposed in landfills. In addition, the act of breaking away the shaft from the base can be time consuming, and it can disturb the tiles if it is not done properly or if the tile is not sufficiently adhering to desired substrate.

Consequently, there is a need for improvement in tile aligning and leveling systems and methods.

SUMMARY OF THE INVENTION

More specifically, an object of the invention is to provide a cost effective tile aligning system.

It is a feature of the present invention to include reusable connecting tabs or shafts.

It is an advantage of the present invention to decrease the materials that are consumed or disposed of for each job.

It is another feature of the invention to include a cap system that is detachable from the tab or shaft, while it remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to provide for the ability to maintain lippage reducing forces over a wider range of tab or shaft elongation.

The present invention includes the above-described features and achieves the aforementioned objects.

Accordingly, the present invention comprises a tile leveling system with a reusable connecting tab; a cap which is easily removable from an attached connecting tab or shaft; or a spring like cap which provides for variable forces between the cap and the tile without any change in the separation between base and the tile.

BRIEF DESCRIPTION OF THE DRAWINGS

In the following description of the drawings, in which like reference numerals are employed to indicate like parts in the various views:

FIG. 5 shows a perspective exploded view of the tab and base combination of the present invention, where the dotted lines show underlying structure which would otherwise not be visible.

FIG. 6 shows a cross section exploded view of the tab and base combination of FIG. 5.

DETAILED DESCRIPTION OF THE DRAWINGS

Figure 1:
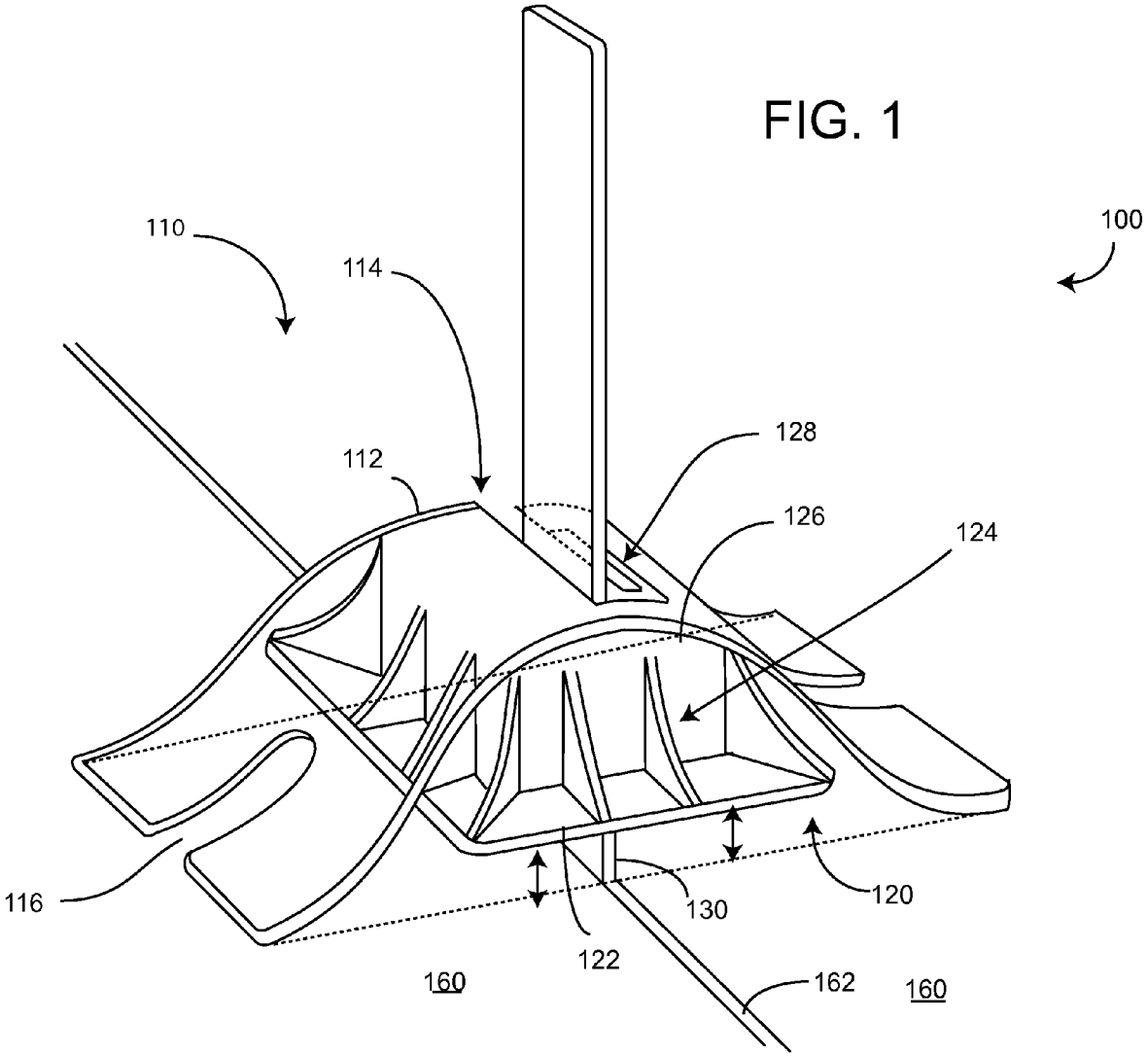
FIG. 1 is a perspective, partially transparent, view of the tile alignment and leveling system of the present invention, in its intended environment when a relatively low pressure is applied.
Figure 2:
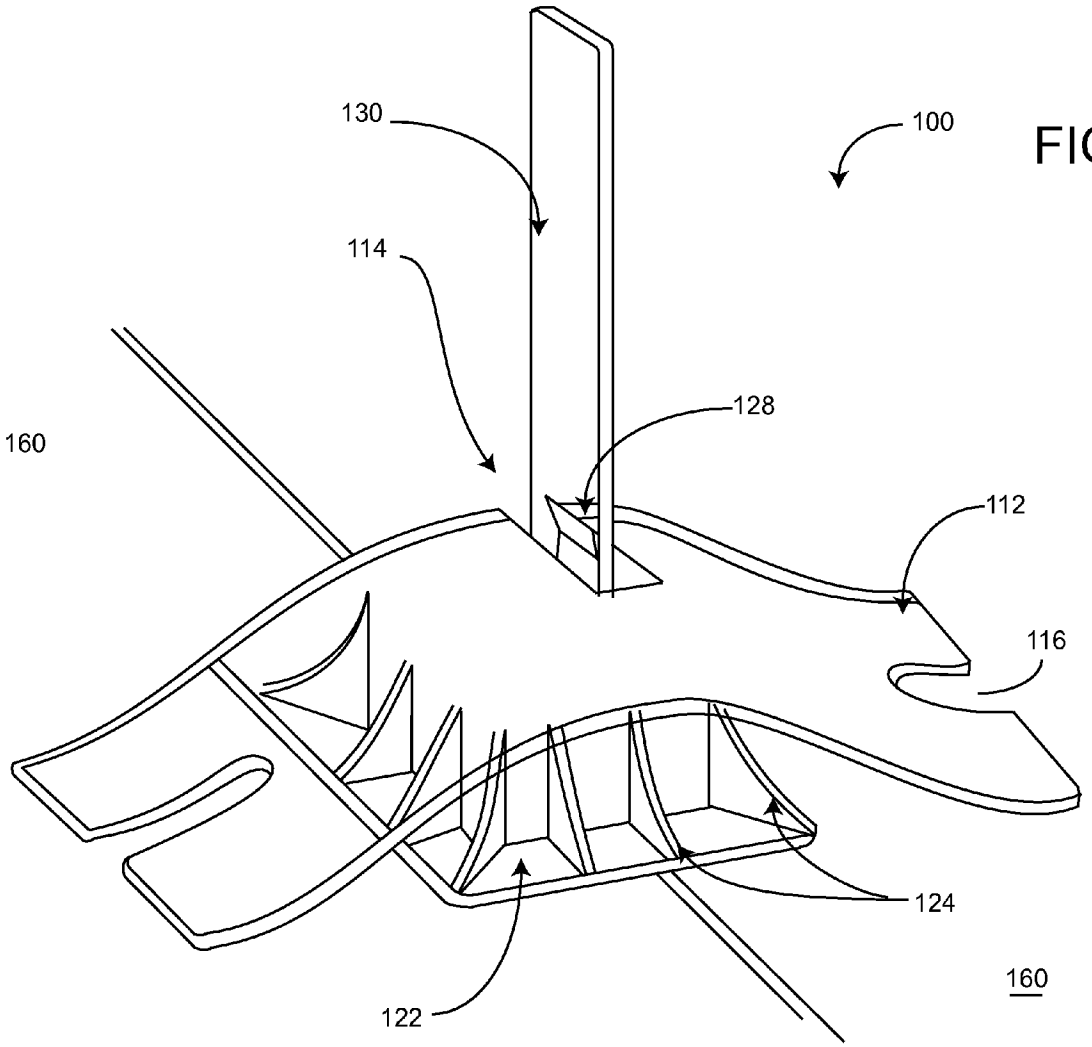
FIG. 2 is a perspective, partially transparent, view of the tile alignment and leveling system of FIG. 1, when a relatively higher pressure is applied.
Figure 3:
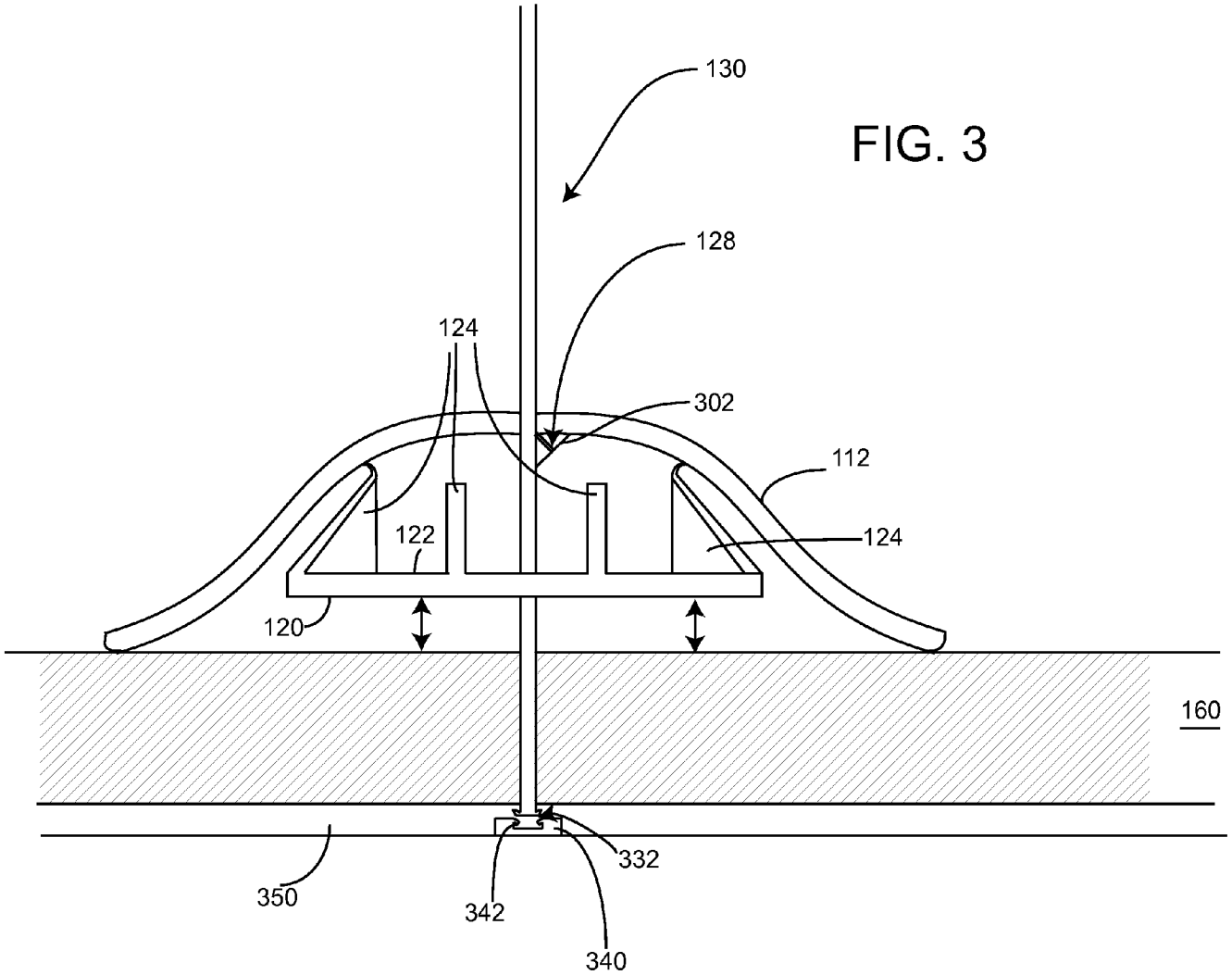
FIG. 3 shows a cross-sectional view of portions of the system as shown in FIG. 1.

Referring now to the drawings, where like numerals refer to like matter throughout, and more particularly to FIG. 1, there is shown a tile alignment and leveling system 100 which generally includes a cap system 110 and a connecting tab 130 which is disposed on the finished side of an array of tiles 160, with a joint 162 therebetween. Cap system 110 is shown having an upper cap spring-like portion 112 and a cap base portion 120. These may be a single piece or multiple pieces of the same or dissimilar material. Upper cap spring-like portion 112 needs to be resilient so as to act like a spring when compressed, downward toward the tile. Note that upper cap spring-like portion 112 is shown in FIGS. 1 and 2 as being partially transparent so that the details of cap base portion 120 can be seen. Cap base portion 120 need not be as resilient but maybe if so desired. Cap system 110 and connecting tab 130 may be made of similar materials as prior art systems such as described in the above referenced patent. However, connecting tab 130 may be made of metal or plastic or rubber coated metal. Upper cap spring-like portion 112 includes an innovative edge tab removal slot 114 which allows for separation of the connecting tab 130 from the cap system 110 while the connecting tab 130 remains coupled to the sub tile base member 340 (FIG. 3). When cap system 110 is moved away, (e.g. slid in one direction) the connecting tab 130 passes through the edge tab removal slot 114 and detachment occurs while connecting tab 130 remains in place. Note this can occur in the configuration of FIG. 1 or FIG. 2. It is not necessary to tip the cap system 110 and thereby increase the pressure at the pivot point and increase the potential for unwanted and potentially disruptive forces on the tile. Cap system 110 can be merely slid out of the way and the connecting tab 130 then can be detached without increasing any pressure on the top surface of the tile. Upper cap spring-like portion 112 also has an optional slot 116. Disposed underneath the upper cap spring-like portion 112 is cap base portion 120 which provides increased surface area for contact between the cap system 110 and the tile. Cap base buttress 124 provides support for the cap base portion core 126 which is located centrally in cap base portion 120. Also located in cap system 110 is gripping tongue 128 which is configured to firmly grip the connecting tab 130. Note that connecting tab 130 does not necessarily require that there be surface features thereon in order to properly function.

One advantage of the present invention over the system of the above referenced patent is that the upper cap spring-like portion 112 acts like a spring which can provide a force which tends to hold adjacent tile in the same relative position, despite a stretching or thermal expansion of said connecting tab 130. Note, in the above referenced patent, if the shaft were to become elongated (even in some cases by a very small amount) as a result of stretching or thermal expansion; then the force applied by the cap onto the adjacent tiles could be completely eliminated. The spring-like nature of the upper cap spring-like portion 112 makes it much less likely that enough elongation will occur to eliminate contact. In other words, it is not as likely that the elongation will be sufficient to overcome the amount of deflection of the upper cap spring-like portion 112.

Now referring to FIG. 2, there is shown a tile alignment and leveling system 100 of FIG. 1 which has been pressed downward so that the cap base flange 122 now touches the tile top surface. It can be seen that the contact surface between the cap system 110 and the tile includes both the points of contact between the upper cap spring-like portion 112 and the cap base flange 122. This area of contact can be several times the area of similar contact in the above described patent.

Now referring to FIG. 3, there is shown the cross-sectional view of the tile alignment and leveling system 100 of FIG. 1. Also shown is gripping tongue support member 302 which is shown as being coupled to the upper cap spring-like portion 112. Note, that when upper cap spring-like portion 112 is pressed downward as in FIGS. 2 and 4 there is deflection of upper cap spring-like portion 112 and therefore relative movement of gripping tongue support member 302/gripping tongue 128 mounted thereon with respect to the connecting tab 130. Also shown in FIG. 3 is the substrate mortar 350 and sub tile base member 340 which is placed in the mortar or against the substrate. Sub tile base member 340 is shown having base mating portion 342 for temporarily grasping the connecting tab base mating member 332 disposed on connecting tab 130. Note, that the base mating portion 342 is designed to release the connecting tab base mating member 332 or otherwise disengage contact with the connecting tab 130 when a requisite force or series of forces is applied thereto. In one embodiment, connecting tab base mating member 332 is a portion of a reusable connecting tab that is removed from the sub tile base member 340 on one job and used again and again on other jobs. In such a configuration only the sub tile base member 340 is a consumable or non-reusable portion of the system. Note: connecting tab base mating member 332 is shown in an enlarged or exaggerated manner for clarity in FIGS. 3 and 4. FIGS. 5 and 6 show embodiments where the widest portion of connecting tab base mating member 332 is not any wider than the widest portion of the remainder of connecting tab 130, this allows for removal of the connecting tab 130 with connecting tab base mating member 332 through the joint in the tile without the need to remove any additional mortar.

Figure 4:
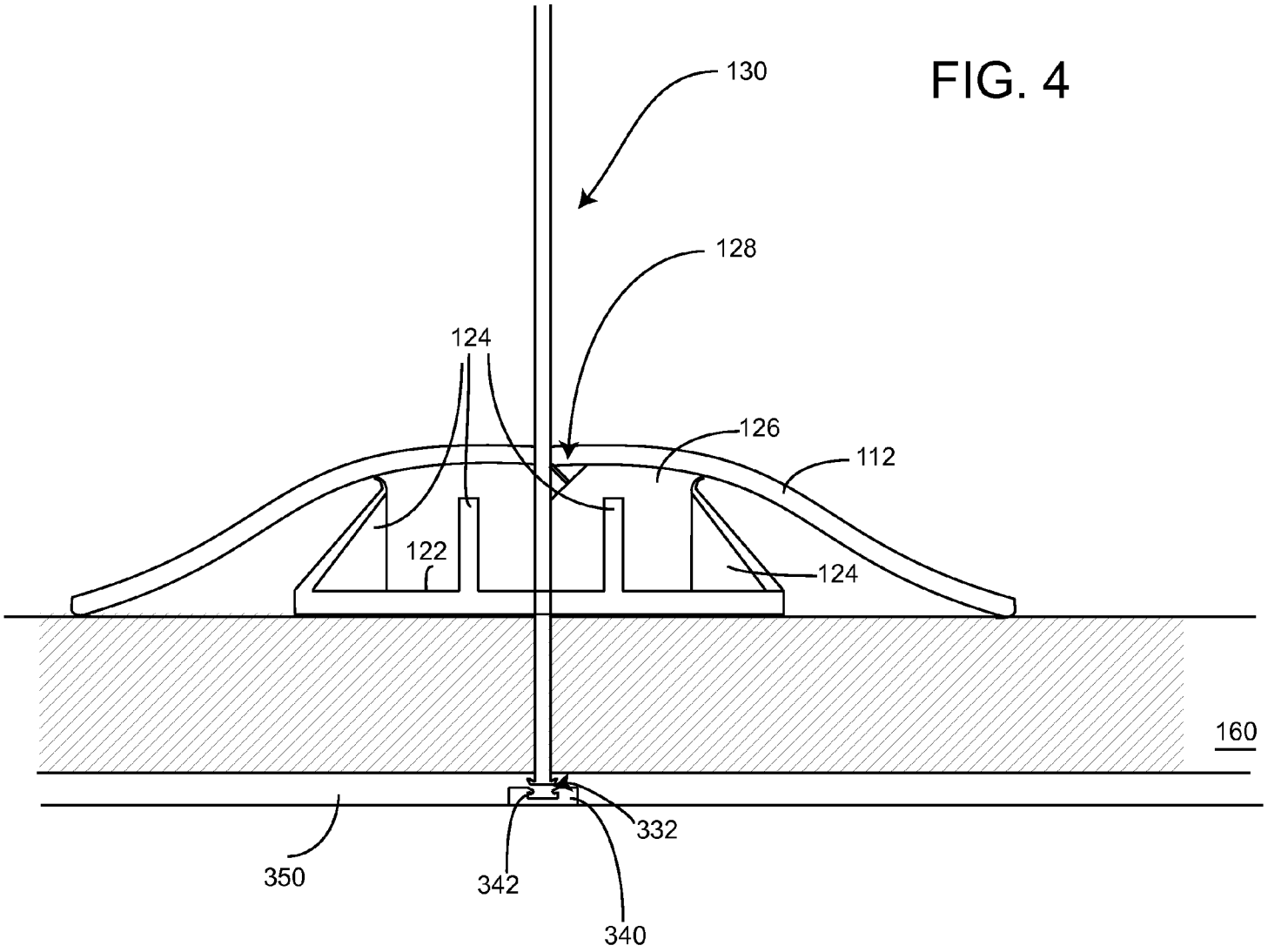
FIG. 4 shows a cross-sectional view of portions of the system as shown in FIG. 2.

Now referring to FIG. 4, there is shown a cross-sectional representation of the tile alignment and leveling system 100 of FIG. 2, which shows the cap base portion 120 touching the tile 160 and the upper cap spring-like portion 112 spread out further. After the initial contact between cap base flange 122 and tile 160 is fully made, the upper cap spring-like portion 112 is configured to apply a variable force between the cap base flange 122 and tile 160 by deflection of the upper cap spring-like portion 112 and without and movement of the cap base portion 120 or the tile 160.

Now referring to FIG. 5, there is shown an exploded perspective view of the connecting tab 130 and sub tile base member 340 combination of the present invention. Sub tile base member 340 is shown having base mating portion 342 which is designed to temporarily grip connecting tab base mating member 332 and then release when the requisite forces are applied. Connecting tab 130 is shown having a connecting tab base mating member 332 which may be a separate metal piece inserted into a connecting tab end opening 504 so that connecting tab mating member internal gripping teeth 502 (shown in dotted lines) hold the connecting tab base mating member 332 in place with respect to the connecting tab 130.

Now referring to FIG. 6, there is shown an exploded cross-sectional view of the connecting tab 130 and sub tile base member 340 combination of the present invention.

In operation, the system of the present invention utilizes the following method:

The reusable connecting tab 130 is coupled to the sub tile base member 340. The system is used to align and level tile in a manner similar to the system described in the above referenced patent, except for the flexing of upper cap spring-like portion 112 after the cap base flange 122 contacts the tile.

In the present invention the upper cap spring-like portion 112 may be, but is not necessarily, compressed and deflected when pressed toward the tile 160. This additional compression of cap system 110 after contact between the cap base flange 122 and the tile provides the force retaining feature to avoid problems associated with undesired elongation of the connecting tab 130.

At the desired time, (e.g. after the mortar is set) the cap system 110 can be removed from the surface of the tile 160 without tipping the cap system 110 and temporarily increasing the forces between the cap and the tile. Instead, the cap system 110 is merely slid away from the connecting tab 130 while the connecting tab 130 remains coupled to the sub tile base member 340. After the cap system 110 has been separated from the connecting tab 130, the re-usable connecting tab 130 is removed from the sub tile base member 340 without the need for increasing downward pressure on portions of the top surface of the tile 160.

The process is repeated for all of the connecting tab 130 and cap system 110 combinations utilized for the job and the re-useable connecting tabs 130 are cleaned and stored for future re-use.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A tile alignment system comprising:

an intermediate releasable member adjacent to a first bottom plate, said first bottom plate is configured to be placed on a back side of a plurality of adjacent structures;

wherein said intermediate releasable member comprises a first planar side and a second opposing planar side each of which are configured to be disposed in a single linear gap between said plurality of adjacent structures, wherein said intermediate releasable member is removable from proximity to said first bottom plate and reusable with a second bottom plate;

a flexible member configured to provide a pressure to a front side of said plurality of adjacent structures, wherein said front side is opposite said back side; and said flexible member is configured to increase said pressure to said front side after contact between a portion of said flexible member and said plurality of adjacent structures is made;

said flexible member is at least indirectly coupled to said intermediate releasable member.

2. The system of claim 1, wherein said structures are tiles and wherein said flexible member comprises a cap.

3. The system of claim 1, wherein said flexible member comprises a portion which contacts said intermediate releasable member.

4. The system of claim 1, wherein said flexible member is configured for increasing said pressure to said front side after contact between said flexible member and said plurality of adjacent structures is made where a relative movement occurs between said flexible member and said plurality of adjacent structures.

5. The system of claim 1, wherein said flexible member and said intermediate releasable member are independent structures.

6. The system of claim 5, wherein said intermediate releasable member extends between said plurality of adjacent structures and said flexible member is configured to slide over said intermediate releasable member.

7. A tile alignment system comprising:

an intermediate reusable member for transmitting a force between a back side of a plurality of adjacent tiles and a portion of a front side, which is an opposite side from said back side; said intermediate member coupled with a bottom plate which is configured to be placed on said back side of said plurality of adjacent tiles;

an above member configured for coupling with the intermediate member for providing a pressure to said front side of said plurality of adjacent tiles;

said intermediate reusable member comprises a first planar side and a second opposing planar side each of which are configured to be disposed in a gap between said plurality of adjacent tiles; and for increasing said pressure to said front side after contact between said above member and said plurality of adjacent tiles is made.

8. The system of claim 7, wherein said intermediate reusable member is detachably coupled with said bottom plate.

9. The system of claim 8, wherein said intermediate reusable member is detachably coupled to said above member.

10. The system of claim 9, wherein said intermediate reusable member provides a portion of a direct physical connection between said back side and said front side.

11. The system of claim 7, wherein said above member is configured to slide down the intermediate reusable member until contact between said above member and said plurality of adjacent tiles.

12. A tile alignment system comprising:

a bottom member which is configured to be placed on a back side of a plurality of adjacent slabs, an intermediate reusable member which comprises a first planar side and a second opposing planar side each of which are configured to be disposed in a gap between said plurality of adjacent slabs, wherein said intermediate reusable member is coupled to said bottom member;

an above the plurality of adjacent slabs member coupled to said intermediate reusable member for providing a pressure to a front side of said plurality of adjacent slabs, where said front side is opposite said back side; and configured for increasing said pressure to said front side as relative movement between said above the plurality of adjacent slabs member and said intermediate reusable member occur.

13. The system of claim 12, wherein said intermediate reusable member is an elongated member.

14. The system of claim 13, wherein said slabs are tiles.

15. The system of claim 14, wherein said back side is below said front side.

16. The system of claim 15, wherein said elongated member is a connecting tab.

17. The system of claim 12, wherein said above the plurality of adjacent slabs member has a slot therein which allows said intermediate reusable member to pass therethrough.

18. The system of claim 17, wherein said above the plurality of adjacent slabs member comprises a flexible member which is configured to contact said plurality of adjacent slabs and apply variable pressure thereon when said flexible member flexes.

19. The system of claim 17, wherein said above the plurality of adjacent slabs member is detachably coupled to said intermediate reusable member and becomes detached from said intermediate reusable member when said intermediate reusable member moves with respect to said slot.

20. The system of claim 19, wherein said above the plurality of adjacent slabs member is a flexible member.

* * * * *